US011384507B2

(12) United States Patent
Yoshihara et al.

(10) Patent No.: US 11,384,507 B2
(45) Date of Patent: Jul. 12, 2022

(54) TURN-DRIVING APPARATUS FOR WORK MACHINE

(71) Applicant: KOBELCO CONSTRUCTION MACHINERY CO., LTD., Hiroshima (JP)

(72) Inventors: Hideo Yoshihara, Hiroshima (JP); Natsuki Yumoto, Hiroshima (JP); Koji Ueda, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 0 days.

(21) Appl. No.: 17/425,059

(22) PCT Filed: Jan. 20, 2020

(86) PCT No.: PCT/JP2020/001671
§ 371 (c)(1),
(2) Date: Jul. 22, 2021

(87) PCT Pub. No.: WO2020/162146
PCT Pub. Date: Aug. 13, 2020

(65) Prior Publication Data

US 2022/0098825 A1 Mar. 31, 2022

(30) Foreign Application Priority Data

Feb. 5, 2019 (JP) ..... JP2019-018536

(51) Int. Cl.
*E02F 9/12* (2006.01)
*E02F 9/22* (2006.01)
(Continued)

(52) U.S. Cl.
CPC ..... *E02F 9/123* (2013.01); *E02F 9/2235* (2013.01); *E02F 9/2296* (2013.01); *F15B 11/02* (2013.01);
(Continued)

(58) Field of Classification Search
CPC ..... F15B 11/04; F15B 2211/6652; F15B 11/0406; F15B 21/087; E02F 9/123; E02F 9/2296
See application file for complete search history.

(56) References Cited

U.S. PATENT DOCUMENTS 3,762,165 A 10/1973 Takenoshita et al.
2005/0204735 A1* 9/2005 Sugano ..... F15B 21/082 60/452
(Continued)

FOREIGN PATENT DOCUMENTS

EP 2 716 919 A1 4/2014
EP 2 980 322 A2 2/2016
(Continued)

OTHER PUBLICATIONS

Extended European Search Report dated Feb. 1, 2022 in European Patent Application No. 20753077.5, 5 pages.
(Continued)

*Primary Examiner* — Abiy Teka
(74) *Attorney, Agent, or Firm* — Oblon, McClelland, Maier & Neustadt, L.L.P.

(57) ABSTRACT

A turn-drive apparatus capable of securing high acceleration at the time of turning start with a reduced relief loss includes a hydraulic pump of a variable capacity type, a turning motor, a turning control device, a relief valve, and a flow rate control device that controls a pump flow rate. The flow rate control device calculates a relief-cut-control target pump flow rate on the basis of the sum of a minimum relief flow
(Continued)

rate and a turning-speed flow rate, and inputs a pump capacity command to the variable capacity-type hydraulic pump based thereon. The flow rate control device makes the relief-cut-control target pump flow rate larger than the sum of the minimum relief flow rate and the turning-speed flow rate at the time of turning start.

5 Claims, 4 Drawing Sheets

(51) Int. Cl.
*F15B 13/02* (2006.01)
*F15B 11/02* (2006.01)

(52) U.S. Cl.
CPC ..... *F15B 13/024* (2013.01); *E02F 9/2285* (2013.01); *F15B 2211/40553* (2013.01)

(56) References Cited

U.S. PATENT DOCUMENTS

2012/0090309 A1 4/2012 Kim
2012/0285152 A1* 11/2012 Sugano ..... F15B 11/0445 60/325
2013/0098021 A1 4/2013 Shin et al.
2014/0166135 A1* 6/2014 Yamashita ..... E02F 9/2296 137/565.16
2016/0032949 A1* 2/2016 Ueda ..... F15B 13/024 60/452
2017/0306590 A1 10/2017 Kondo et al.

FOREIGN PATENT DOCUMENTS

JP 49-49545 12/1974
JP 2011-208790 A 10/2011
JP 2013-531201 A 8/2013
JP 2016-31125 A 3/2016
WO WO 2012/160770 A1 11/2012
WO WO 2014/112164 A1 7/2014

OTHER PUBLICATIONS

International Search Report dated Mar. 17, 2020 in PCT/JP2020/001671 filed Jan. 20, 2020, 2 pages.

* cited by examiner

TURN-DRIVING APPARATUS FOR WORK MACHINE

TECHNICAL FIELD

The present invention relates to a turning drive apparatus provided in a work machine such as a hydraulic excavator.

BACKGROUND ART

On a work machine equipped with a turning body is mounted a turning drive apparatus for turning the turning body. For example, a hydraulic excavator is provided with a drive apparatus for hydraulically turning the upper turning body, the drive apparatus including a hydraulic pump for discharging hydraulic fluid, and a hydraulic motor (turning motor) that is operated to turn the upper turning body by supply of the operating fluid to the hydraulic motor. For such a turning drive apparatus, it is important to efficiently turn the upper turning body having a large moment of inertia.

For example, Patent Literature 1 discloses a drive apparatus capable of performing relief cut control for reducing a relief loss to improve drive efficiency. The relief cut control is a control of operating the capacity of a variable displacement hydraulic pump so as to secure a flow rate necessary for turning the turning body while minimizing a relief flow rate which is a flow rate of hydraulic fluid flowing through the relief valve. Specifically, the relief cut control includes calculating the sum of a minimum relief flow rate and a turning-speed flow rate, as a target pump flow rate, and determining the pump capacity of the hydraulic pump for providing the pump flow rate equal to the target pump flow rate. The minimum relief flow rate is a minimum required relief flow rate to secure the relief pressure necessary for driving the turning body, and the turning-speed flow rate is a flow rate of hydraulic fluid actually flowing through the turning motor that is turning the turning body, the flow rate corresponding to the turning speed.

An apparatus that performs the above-described relief cut control has a problem of difficulty in securing turning acceleration enough to satisfy the operator's requirement at the start of the turning because of the characteristics of the variable displacement hydraulic pump. Specifically, the variable displacement hydraulic pump has such a characteristic that the higher the pump capacity (for example, the larger the tilt angle), the higher the volumetric efficiency $\eta v$ is obtained, whereas the relief cut control restricts the pump capacity at the time of turning start with a turning speed of 0 or extremely low to a capacity corresponding to a minimum required pump flow rate or a small capacity close thereto, which hinders high volumetric efficiency from being provided at the time of turning start. This involves the disadvantage of taking time to raise the actual pump pressure to the pressure necessary for activating the rotating body.

The volumetric efficiency $\eta v$ is the ratio of the actual discharge flow rate Q to the theoretical discharge flow rate Qth of the hydraulic pump ($\eta v=Q)/Qth$), and the theoretical discharge flow rate Qth is represented by the product of the displacement volume V corresponding to the set tilt angle and the number of pump revolutions (for example, the number of engine revolutions) N ($Qth=V\times N$). The difference between the theoretical discharge flow rate Qth and the actual discharge flow rate Q corresponds to a loss due to internal leakage of the pump.

CITATION LIST

Patent Literature

Patent Literature 1: JP-A 2016-31125

SUMMARY OF INVENTION

An object of the present invention is to provide a turning drive apparatus for hydraulically turning a turning body included in a work machine, the apparatus being capable of securing high acceleration performance at the start of the turning with a reduced relief loss.

Provided is a turning drive apparatus installed in a work machine, which includes a machine body, a turning body turnably mounted on the machine body, and an engine that generates a power for driving the turning body, to hydraulically turn the turning body, the apparatus including: a variable displacement hydraulic pump that is driven by the engine to discharge hydraulic fluid; a turning motor composed of a hydraulic motor that is operated by supply of hydraulic fluid from the hydraulic pump to the hydraulic motor to turn the turning body; a turning control device operated by application of a turning command operation to the turning control device to allow hydraulic fluid to be supplied from the hydraulic pump to the turning motor to turn the turning body; a relief valve provided in a relief flow path for releasing hydraulic fluid discharged from the hydraulic pump to a tank and configured to open so as to restrict a pump pressure, which is a pressure of hydraulic fluid supplied to the turning motor, to a preset pressure or less; a turning speed detector that detects a turning speed of the turning body; and a flow rate control device that changes a pump capacity, which is a capacity of the hydraulic pump, when the turning command operation is applied to the turning control device, to thereby control a pump flow rate, which is a flow rate of the hydraulic fluid discharged from the hydraulic pump. The flow rate control device includes: a turning-speed flow rate calculation part that calculates a turning-speed flow rate, which is a flow rate of hydraulic fluid to be made to flow through the turning motor in accordance with the turning speed detected by the turning speed detector when the turning body is turned; a relief-cut-control target flow rate calculation part that calculates a relief-cut-control target pump flow rate which is a target value of the pump flow rate, on the basis of a sum of the turning-speed flow rate and a minimum relief flow rate, which is a relief flow rate of the hydraulic fluid flowing through the relief valve and a minimum flow rate necessary for securing the pump pressure necessary for opening the relief valve to start the turning body; and a pump capacity command part that inputs a pump capacity command for changing the pump capacity so as to provide the relief-cut-control target pump flow rate that is calculated by the relief-cut-control target pump flow rate calculation part. The relief-cut-control target pump flow rate calculation part and the pump capacity command part are configured to make the pump capacity larger than the pump capacity corresponding to the sum of the minimum relief flow rate and the turning-speed flow rate at a time of turning start in which the turning command operation is applied to the turning control device and the turning speed is lower than a setting turning speed that is preset.

DESCRIPTION OF EMBODIMENTS

There will be described a preferred embodiment of the present invention with reference to the drawings.

Figure 1:
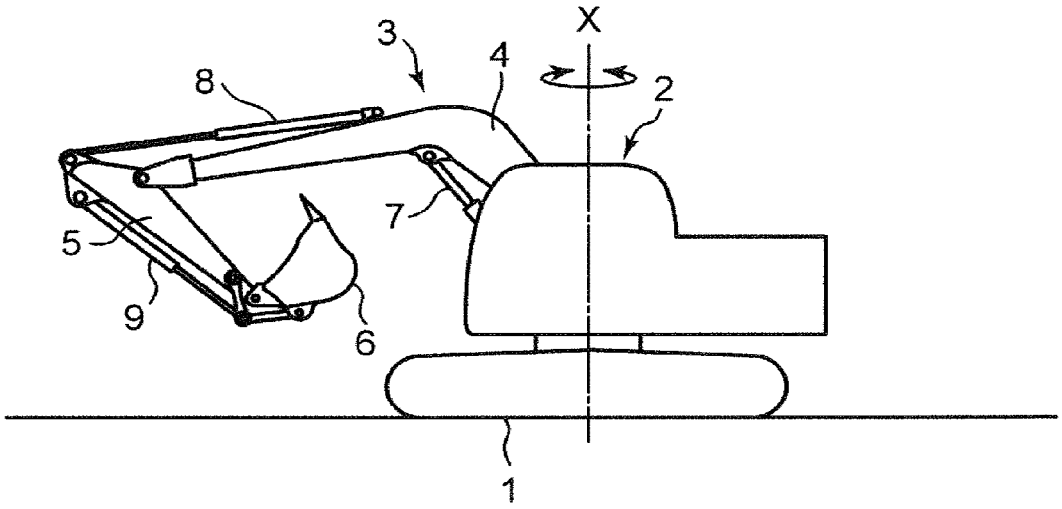
FIG. 1 is a side view of a hydraulic excavator that is a work machine according to an embodiment of the present invention.

FIG. 1 shows a hydraulic excavator as a work machine according to an embodiment of the present invention. The hydraulic excavator includes: a lower traveling body 1 which is a machine body; an upper turning body which is a turning body mounted on the lower traveling body 1 so as to be turnable around a turning axis X; and a work attachment 3 mounted on the upper turning body 2.

The work attachment 3 includes a boom 4, an arm 5, a bucket 6, and a plurality of extendable hydraulic cylinders, namely, a boom cylinder 7, an arm cylinder 8, and a bucket cylinder 9. The boom 4 has a proximal end to be connected to the upper turning body 2 rotatably in a derricking direction and a distal end opposite to the proximal end. The arm 5 has a proximal end rotatably connected to the distal end of the boom 4 and a distal end opposite to the proximal end, the bucket 6 rotatably attached to the distal end of the arm 5. The boom cylinder 7 is interposed between the boom 4 and the upper turning body 2 so as to cause the boom 4 to be derricked by the expansion and contraction motions thereof. Similarly, the arm cylinder 8 is interposed between the boom 4 and the arm 5 so as to cause the arm 5 to be rotationally moved by the expansion and contraction motions thereof, and the bucket cylinder 9 is interposed between the arm 5 and the bucket 6 so as to cause the bucket 6 to be rotationally moved by the expansion and contraction motions thereof.

Figure 2:
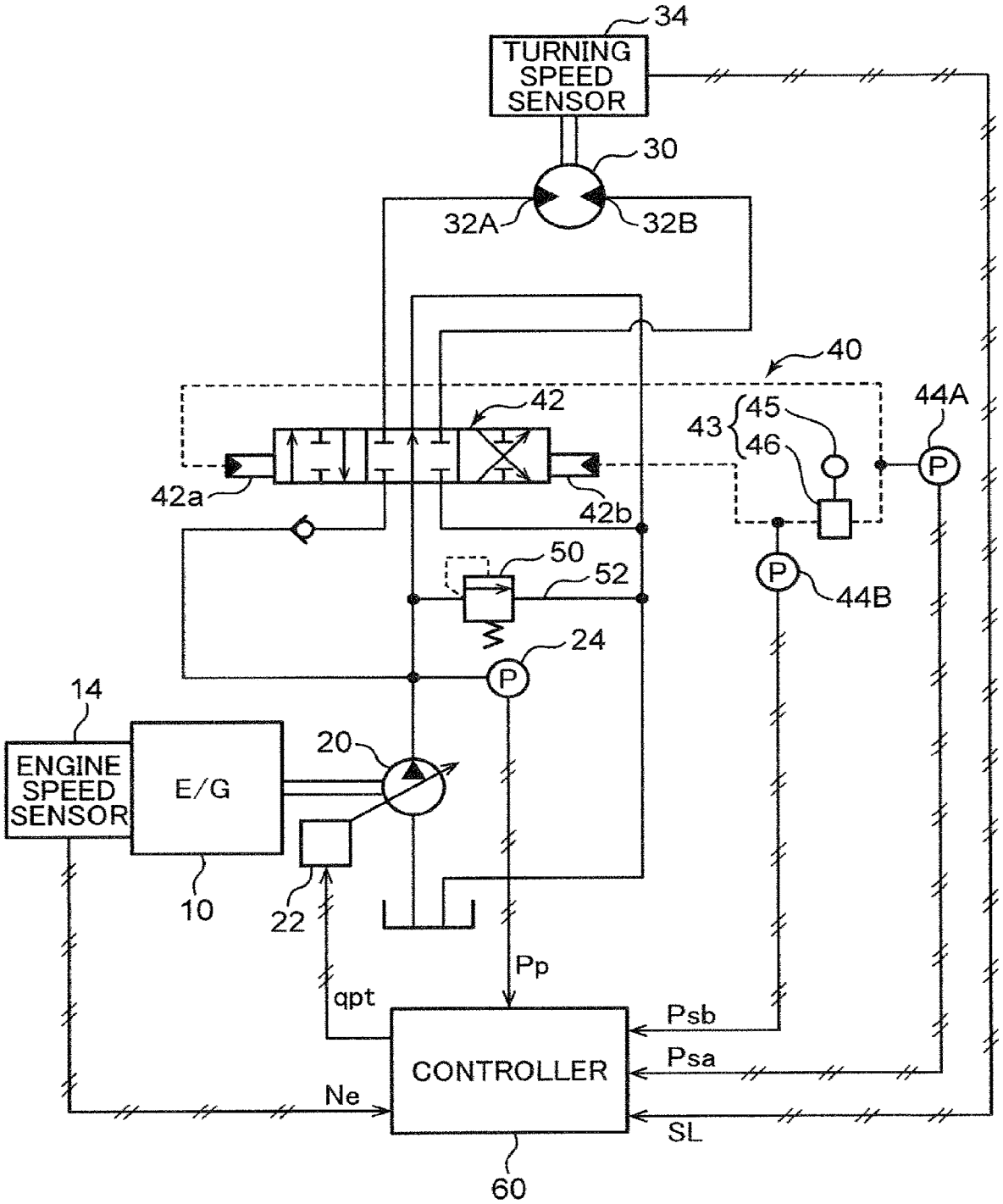
FIG. 2 is a circuit diagram showing a turning drive apparatus installed in the hydraulic excavator.

FIG. 2 is a circuit diagram showing a turning drive apparatus according to the present embodiment. The turning drive apparatus is an apparatus for hydraulically turning the upper turning body 2 to the lower traveling body 1 by use of an engine 10 mounted on the hydraulic excavator as a power source, the apparatus including a hydraulic pump 20, a turning motor 30, a turning control device 40, a relief valve 50, a plurality of sensors, and a controller 60.

The hydraulic pump 20 is connected to the output shaft of the engine 10 and driven by the engine 10 to thereby suck and discharge hydraulic fluid in the tank. The hydraulic pump 20 is a variable displacement type. Specifically, the hydraulic pump 20 includes a pump body configured to have an adjustable capacity and a pump regulator 22 attached thereto. The pump regulator 22 is operated by input of a pump capacity command from the controller 60 so as to change a pump capacity, which is the capacity of the pump body. The pump capacity command is a signal that specifies a target pump capacity qpt, and the pump regulator 22 operates the pump body to adjust the actual pump capacity to the target pump capacity qpt.

The turning motor 30 is a hydraulic motor which is operated by supply of hydraulic fluid from the hydraulic pump 20 to the hydraulic motor to turn the turning body. Specifically, the turning motor 30 includes an output shaft connected to the upper turning body 2 and a motor body which is operated by supply of operating fluid to the motor body to rotate the output shaft. The turning motor 30 has a right turning port 32A and a left turning port 32B. The turning motor 30 is configured to be operated by supply of hydraulic fluid to the right turning port 32A so as to discharge hydraulic fluid through the left turning port 32B while turning the upper turning body 2 rightward and, conversely, to be operated by supply of hydraulic fluid to the left turning port 32B so as to discharge hydraulic fluid through the right turning port 32A while turning the upper turning body 2 leftward. The turning motor 30 turns the upper turning body 2 at the speed corresponding to the flow rate of hydraulic fluid flowing through the turning motor 30.

The turning control device 40 is operated by a turning command operation that is applied to the turning control device 40 by an operator to allow hydraulic fluid to be supplied from the hydraulic pump to the turning motor to turn the turning body. The turning control device 40 according to the present embodiment includes a turning control valve 42 and a turning operation valve 43.

The turning control valve 42 is interposed between the hydraulic pump 20 and the turning motor 30 and operated so as to switch the direction in which hydraulic fluid is supplied from the hydraulic pump 20 to the turning motor 30 and so as to change the flow rate of the hydraulic fluid.

The turning control valve 42 shown in FIG. 2 is composed of a pilot-operated directional selector valve having a right turning pilot port 42*a* and a left turning pilot port 42*b*. With no input of pilot pressure to any of the right turning and the left turning pilot ports 42*a* and 42*b*, the turning control valve 42 is kept in a neutral state (the central position in FIG. 2) to block the communication between the hydraulic pump 20 and the turning motor 30. By input of the pilot pressure (right turning pilot pressure) to the right turning pilot port 42*a*, the turning control valve 42 is opened so as to shift from the neutral state to a right turning state (the left position in FIG. 2) by the stroke corresponding to the magnitude of the pilot pressure. Specifically, the turning control valve 42 is opened so as to allow the hydraulic fluid discharged from the hydraulic pump 20 to be supplied to the right turn port 32A of the turning motor 30 at the flow rate corresponding to the magnitude of the pilot pressure. By input of the pilot pressure (left turning pilot pressure) to the left turning pilot port 42*b*, conversely, the turning control valve 42 is opened so as to shift from the neutral state to a left turning state (the right position in FIG. 2) by the stroke corresponding to the magnitude of the pilot pressure. Specifically, the turning control valve 42 is opened so as to allow the hydraulic fluid discharged from the hydraulic pump 20 to be supplied to the left turn port 32B of the turning motor 30 at the flow rate corresponding to the magnitude of the pilot pressure.

The turning operation valve 43 constitutes a turning operation device that is operated by the turning command operation applied thereto to thereby apply a pilot pressure corresponding to the turning command operation to the turning control valve 42 to operate it. Specifically, the turning operation valve 43 includes a turning operation lever 45 and a turning pilot valve 46.

The turning operation lever 45 is an operation member provided in an operation room included in the upper turning body 2. The turning operation lever 45 allows a turning command operation, for example, an operation for tilting the turning operation lever 45, to be applied to the turning operation lever 45 by an operator, being connected to the turning pilot valve 46 so as to cause the turning pilot valve 46 to be opened in conjunction with the tilt of the turning operation lever 45.

The turning pilot valve 46 is interposed between a not-graphically-shown pilot hydraulic source (for example, a pilot pump that is driven by the engine 10) and the right turning and left turning pilot ports 42*a* and 42*b* of the turning control valve 42, and opened in response to the turning command operation applied to the turning operation lever 45 to thereby allow the pilot pressure to be supplied to one of the right turning and the left turning pilot ports 42*a* and 42*b* from the pilot hydraulic source. Specifically, by the turning command operation applied to the turning operation lever 45, the turning pilot valve 46 is opened so as to allow the pilot pressure corresponding to the magnitude of the turning command operation to be supplied to the pilot port corresponding to the direction of the turning command operation out of the right turning and the left turning pilot ports 42*a* and 42*b*.

The relief valve 50 is provided in a relief flow path 52 and operated so as to open and close the relief flow path 52. The relief flow path 52 is a flow path providing direct connection between the pump line and the tank line to let the hydraulic fluid discharged from the hydraulic pump 20 released to the tank so as to bypass the turning control valve 42. The relief valve 50 is opened so as to restrict the pump pressure Pp, which is the pressure of hydraulic fluid discharged from the hydraulic pump 20, to a relief setting pressure Prf that is preset or less. Specifically, the relief valve 50 is opened to the maximum opening when the primary pressure thereof (i.e., the pump pressure Pp) becomes equal to or higher than the relief setting pressure Prf to open the relief flow path 52 at the maximum opening area, thereby inhibiting the rise of the pump pressure Pp beyond the relief setting pressure Prf.

The controller 60, which is, for example, composed of a microcomputer having an arithmetic control function, serves as a flow control device according to the present invention. Specifically, the controller 60 has a function of changing a pump capacity qp, which is the capacity of the hydraulic pump 20, in response to the application of the turning command operation to the turning operation valve 43 to thereby control a pump flow rate Qp which is the flow rate of hydraulic fluid discharged from the hydraulic pump 20.

The plurality of sensors, which are disposed to input information for enabling the controller 60 to execute the flow control to the controller 60, includes an engine speed sensor 14, a pump pressure sensor 24, a turning speed sensor 34, a right turning pilot pressure sensor 44*a*, and a left turning pilot pressure sensor 44*b*. The engine speed sensor 14 detects the number of engine revolutions Ne corresponding to the rotational speed of the engine 10. The pump pressure sensor 24 is a pressure sensor that detects the pump pressure Pp. The turning speed sensor 34 is a turning speed detector that detects the turning speed SL of the upper turning body 2 driven by the turning motor 30. The right turning and left turning pilot pressure sensors 44A and 44B are pressure sensors that detect the right turning pilot pressure Psa and the left turning pilot pressure Psb applied to the turning control valve 42 from the turning operation valve 43, respectively (in other words, detect the direction and magnitude of the turning command operation applied to the turning operation valve 43). Each of the sensors 14, 24, 34, 44A and 44B generates a detection signal, which is an electric signal corresponding to the physical quantity to be detected, and inputs the detection signal to the controller 60.

Figure 3:
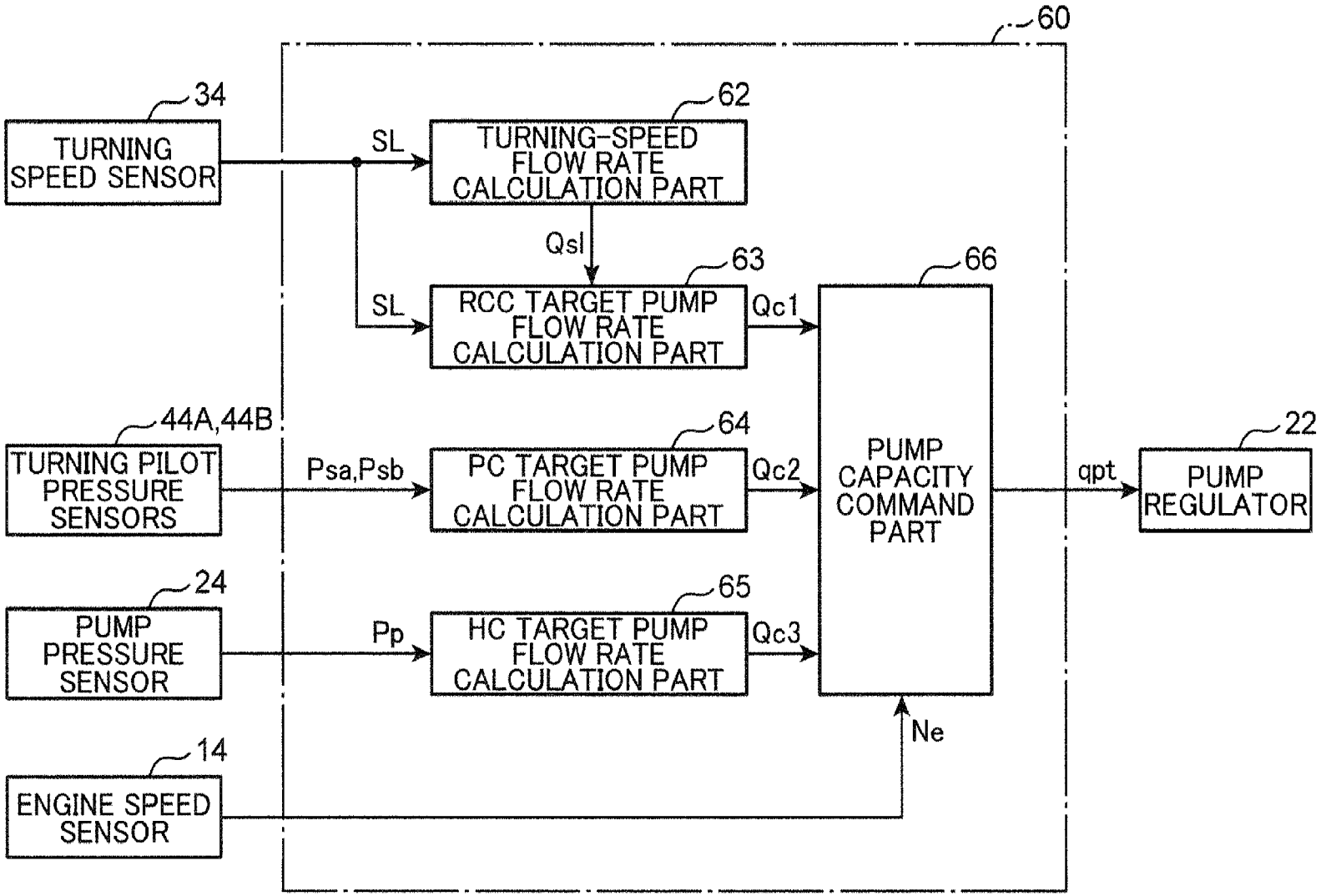
FIG. 3 is a block diagram showing a functional configuration of a controller included in the turning drive apparatus.

As functions for controlling the pump flow rate Qp, the controller 60 includes, as shown in FIG. 3, a turning-speed flow rate calculation part 62, a relief-cut-control target pump flow rate calculation part 63, which is referred to as "RCC target pump flow rate calculation part 63" in the below description and FIG. 3, a positive-control target pump flow rate calculation part 64, which is referred to as "PC target pump flow rate calculation part 64", in the below description and FIG. 3, a horsepower-control target pump flow rate calculation part 65, which is referred to as "HC target pump flow rate calculation part 65" in the below description and FIG. 3, and a pump capacity command part 66. There will be described the arithmetic control operations executed by them with additional reference to the flowchart shown in FIG. 4.

When the turning command operation is applied to the turning operation valve 43 (YES in step S1), the turning-speed flow rate calculation part 62 calculates a turning-speed flow rate Qs1 (step S2), and the RCC target pump flow rate calculation part 63 calculates a relief-cut-control target pump flow rate Qc1 (referred to as "RCC target pump flow rate Qc1" in the below description and FIG. 4) based on the turning-speed flow rate Qs1 (Step S3*a*). In parallel with this, the PC target pump flow rate calculation part 64 calculates a positive-control target pump flow rate Qct (referred to as "PC target pump flow rate Qc2" in the below description and FIG. 4) (Step S3*b*), and the HC target pump flow rate calculation part 65 calculates a horsepower-control target pump flow rate Qc3 (referred to as "HC target pump flow rate Qc3" in the below description and FIG. 4) (Step S3C).

The turning-speed flow rate Qs1 calculated in the step S2 is the flow rate of hydraulic fluid to be made to flow through the turning motor 30 during the turning of the upper turning body 2 in response to the turning speed SL detected by the turning speed sensor 34. The turning-speed flow rate calculation part 62 calculates the product of the turning speed SL and the motor capacity qm of the turning motor 30 as the turning-speed flow rate Qs1 (Qs1=SL×QM).

The RCC target pump flow rate Qc1 calculated in step S3*a* is the target pump flow rate calculated for execution of the relief cut control. The relief cut control is a control of operating the pump capacity qp of the hydraulic pump 20 so as to secure a flow rate necessary for turning the upper turning body 2 while minimizing a relief flow rate which is the flow rate of hydraulic fluid flowing through the relief valve 50. Accordingly, the RCC target pump flow rate Qct is basically calculated based on the sum of the minimum relief flow rate Qrf and the turning-speed flow rate Qs1, the minimum relief flow rate Qrf being the minimum required relief flow rate to secure the pump pressure Pp necessary for opening the relief valve 50 to start the upper turning body 2.

However, the ratio of the actual discharge flow rate Q to the theoretical discharge flow rate Qth of the hydraulic pump, namely, the volumetric efficiency ηv of the hydraulic pump 20, is decreased with a decrease in the pump capacity; therefore, if the RCC target pump flow rate Qc1 is restricted to a flow rate substantially equal to the minimum relief flow rate Qrf at the time of turning start in which the turning speed SL is extremely low, it takes time to increase the actual pump pressure Pp to the pressure necessary for starting the turning body, in spite of application of a large turning command operation by an operator, because high volumetric efficiency ηv cannot be obtained, which prevents the acceleration required by the operator from being satisfied.

Figure 4:
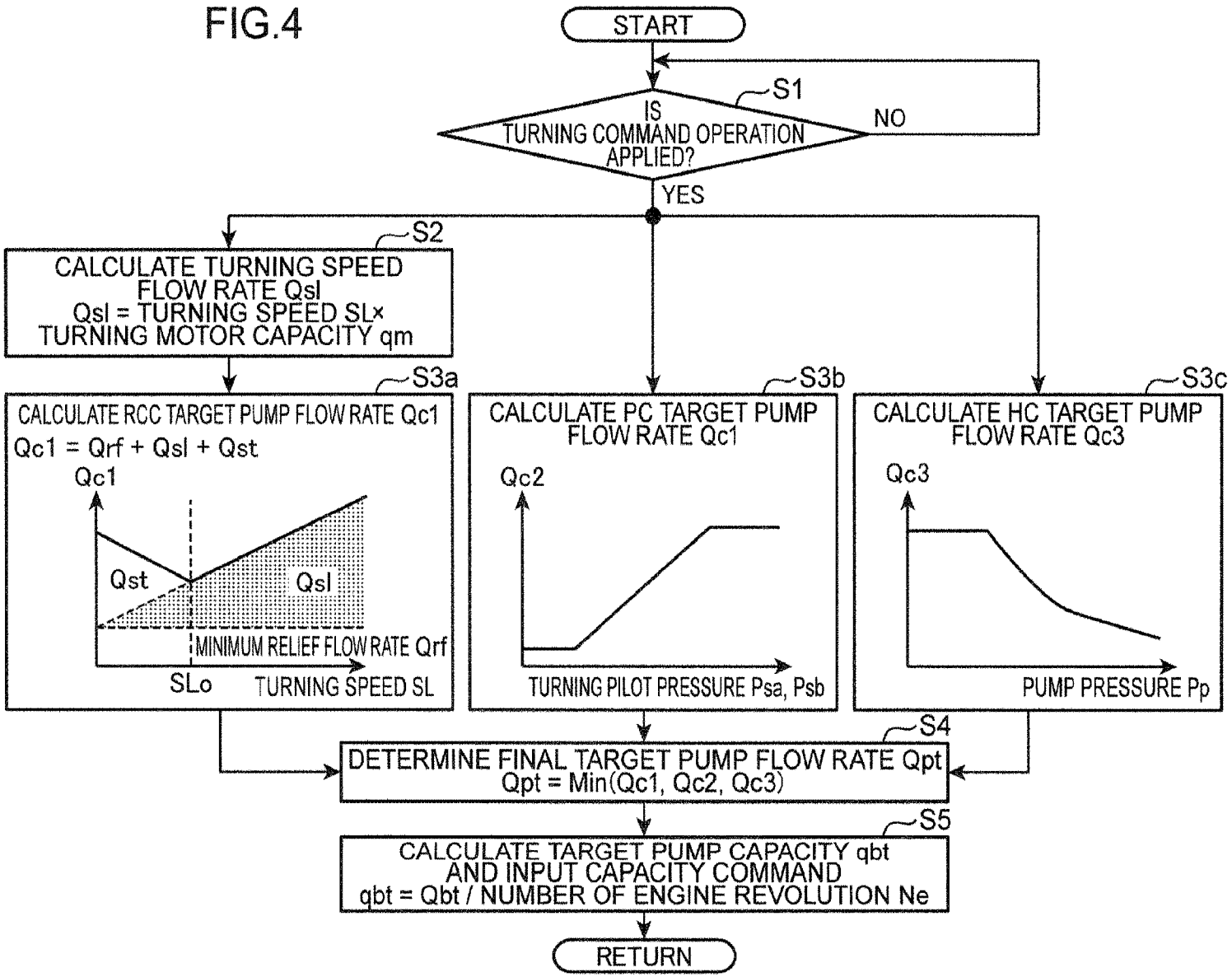
FIG. 4 is a flowchart showing an arithmetic control operation executed by the controller shown in FIG. 3.

In view of this, the RCC target pump flow rate calculation part according to the present embodiment is configured to set the turning start flow rate Qst with a positive value (>0) only at the time of turning start, specifically, only when a turning operation command is applied to the turning operation valve 43 (YES in step S1) and the turning speed SL detected by the turning speed sensor 34 is less than a predetermined setting turning speed SLo, as shown in step S3*a* of FIG. 4, and configured to calculate a value obtained by adding the turning start flow rate Qst to the sum of the minimum relief flow rate Qrf and the turning-speed flow rate Qs1, as the relief-cut-control target pump flow rate Qc1.

This calculation operation of the RCC target pump flow rate Qc1 only has to increase the RCC target pump flow rate Qc1 by the amount of the turning start flow rate Qst only at the time of turning start and set the RCC target pump flow rate Qc1 to the sum of the minimum relief flow rate Qrf and the turning-speed flow rate Qs1 at the time of normal turning with the turning speed SL equal to or higher than the setting turning speed SLo, while the calculation procedure for obtaining the result is not limited. The calculation of the RCC target pump flow rate Qc1 at the time of normal turning may be achieved, for example, by either setting the turning start flow rate Qst only at the time of turning start to make it included in the RCC target pump flow rate Qc1 or making the RCC target pump flow rate Qc1 always include the turning start flow rate Qst while setting the turning start flow rate Qst to 0 at the time of normal turning (SL≥SLo).

As shown in step S3*a* in FIG. 4, the RCC target pump flow rate calculation part 63 according to the present embodiment sets the turning start flow rate Qst so as to decrease the turning start flow rate Qst with an increase in the turning speed SL. This makes it possible to set a large pump capacity qp, when the turning speed SL is low even at the time of turning start to thereby make the large pump capacity qp large and secure a high volumetric efficiency ηv corresponding thereto, and makes it possible to reduce the RCC target pump flow rate Qc1 with an increase in the turning speed SL, which lowers the requirement for acceleration, thereby increasing the priority of reducing the relief loss.

More specifically, the RCC target pump flow rate calculation part 63 according to the present embodiment sets the turning start flow rate Qst so as to continuously decrease the turning start flow rate Qst to zero with an increase in the turning speed SL to the setting turning speed SLo. This prevents the pump capacity qp from being abruptly changed by an increase in the turning speed SL across the setting turning speed SLo, thereby allowing smoother turning drive to be performed.

The turning start flow rate Qst may be either calculated based on a pre-prepared calculation formula with respect to the relationship between the turning speed SL and the turning start flow rate Qst or determined by use of a pre-prepared map with respect to the relationship. Alternatively, it is also possible to always keep the turning start flow rate Qst at the time of starting turning a constant value.

The PC target pump flow rate Qc2 calculated in step S3*b* is a target pump flow rate that is calculated for execution of a positive control, which is a control of increasing the pump capacity qp with an increase in the turning command operation. Specifically, the PC target pump flow rate calculation part 64 calculates the PC target pump flow rate Qc2 based on a pilot pressure corresponding to the turning command operation, that is, a larger pilot pressure out of the right turning and the left turning pilot pressures Psa and Psb, by use of an arithmetic expression or a map prepared in advance with respect to the relationship between the pilot pressure and the PC target pump flow rate Qc2, that is, a characteristic in which the PC target pump flow rate Qc2 is increased with an increase in the turning pilot pressure Psa or Psb as shown in step S3*b* in FIG. 4.

The HC target pump flow rate Qc3 calculated in step S3*c* is a target pump flow rate that is calculated for execution of a horsepower control, which is a control of limiting the pump flow rate Qp so as to keep the product of the pump pressure Pp and the pump flow rate Qp under a horsepower curve that is determined on the basis of the capacity of the engine 10. The HC target pump flow rate calculation part 65 calculates the HC target pump flow rate Qc3 based on a curve preset with respect to the relationship between the pump pressure Pp and the HC target pump flow rate Qc3 (for example, a curve that is shown in step S3*c* in FIG. 4 and corresponds to the horsepower curve).

After the calculation of the target pump flow rates Qc1, Qc2, and Qc3, the pump capacity command part 66 of the controller 60 selects the lowest one of the target pump flow rates Qc1, Qc2, and Qc3 and sets the selected one to the final target pump flow rate Qpt (step S4). In other words, the final target pump flow rate Qpt is determined with priority to the lowest one of the target pump flow rates Qc1, Qc2, and Qc3. Furthermore, the pump capacity command part 66 calculates a value obtained by dividing the thus determined final target pump flow rate Qpt by the number of engine revolutions Ne detected by the engine speed sensor 14 as the target pump capacity qpt, then generating a pump capacity command for bringing the actual pump capacity qp close to the target pump capacity qpt and inputting the pump capacity command to the pump regulator 22 of the hydraulic pump 20 (step S5).

Thus can be performed such a pump flow rate control as to bring the pump flow rate Qp of the hydraulic pump 20 close to the final target pump flow rate Qpt. This enables the pump capacity command part 66, in the case where a large turning command operation (i.e., an operation requiring to start turning of the upper turning body 2 with high acceleration) is applied to the turning operation valve 43, while the upper turning body 2 is stopped, to give priority to the RCC target pump flow rate Qc1 for the determination of the final target pump flow rate Qpt, to make the final target pump flow rate Qpt larger than the sum of the minimum relief flow rate Qrf and the turning-speed flow rate Qs1 by the turning start flow rate Qst (in other words, to make the actual relief flow rate larger than the minimum relief flow rate Qrf) to thereby execute the pump flow rate control that satisfies the above acceleration requirement while basically executing the relief cut control.

In contrast, in the case where a small turning command operation is applied to the turning operation valve 43 to give priority to the PC target pump flow rate Qc2 for the determination of the final target pump flow rate Qpt, that is, in the case where high acceleration is not required, the pump capacity command part 66 can maximumly reduce the relief loss by restricting the final target pump flow rate Qpt to a low flow rate corresponding to the turning command operation.

Besides, in the case where the HC target pump flow rate Qc3 is lower than either of the target pump flow rates Qc1 and Qc2, the pump capacity command part 66 gives priority to the HC target pump flow rate Qc3, whichever the RCC target pump flow rate Qc1 or the PC target pump flow rate Qc2 is lower, thereby preventing inconvenience such as engine stop due to excessive horsepower requirement.

The present invention is not limited to the above-described embodiment. The present invention also encompasses, for example, the following modes.

(A) Setting of Turning Start Flow Rate Qst

In the case where the turning start flow rate Qst is set for calculating the RCC target pump flow rate in the present invention, the value thereof can be suitably set in consideration of the characteristics (especially volume efficiency) of the hydraulic pump. Besides, the setting turning speed SLo which corresponds to the upper limit turning speed at the time of turning start can also be freely set according to the preference of an operator or the characteristics of the work machine (the moment of inertia of the upper turning body 2, the characteristics of the hydraulic pump, the hydraulic motor, etc.).

Although the value of the RCC target pump flow rate Qc1 at the time of turning start in the example shown in FIG. 4 is set to a large one enough to be larger than the value at the setting turning speed SLo, the turning start flow rate Qst may be set so that the value of the RCC target pump flow rate Qc1 at the time of the turning start is approximately equal to the value at the setting turning speed SLo (for example, a constant value) or kept smaller than the value.

Furthermore, the effect of securing sufficient acceleration at the time of turning start can be achieved also by means other than the setting of the turning start flow rate Qst. For example, at the time of turning start, not making the turning start flow rate Qst included in the RCC target pump flow rate Qc1 but adding a preset correction amount to the target pump capacity qpt calculated on the basis of the RCC target pump flow rate Qc1 also makes it possible to secure high acceleration performance at the time of turning start.

(B) Hydraulic Pump

The hydraulic pump according to the present invention may be one that is not dedicated to the turning motor but used also for driving other hydraulic actuators. Also in this case, giving priority to the relief cut control at least at the time of turning start enables the effect of the present invention to be provided.

(C) Turning Control Device

The turning control device according to the present invention is not limited to the combination of the turning control valve 42 and the turning operation valve 43. The turning control device can also be constituted by, for example, a solenoid valve interposed between the pilot hydraulic source and the pilot ports 42*a* and 42*b* of the turning control valve 42 to change pilot pressure, an electric lever device allowing a turning command operation to be applied thereto and generating a turning command signal which is an electric signal corresponding to the turning command operation, and a pilot pressure operation unit that inputs a pilot pressure command signal to the solenoid valve so as to cause a pilot pressure corresponding to the turning command signal to be input to the pilot ports 42*a* and 42*b*.

(D) Pump Flow Rate Control Other than Relief Cut Control

The present invention can be broadly applied to any case where the pump flow control to be executed includes at least a relief cut control. The present invention encompasses, for example, a mode where only the relief cut control is executed while no positive control or no horsepower control is executed, and a mode where another control is executed with the relief cut control instead of or in addition to the positive control and the horsepower control. In a mode, such as the latter mode, where a plurality of controls are executed, including at least the relief cut control and the positive control, generating a pump capacity command with priority to a lower target pump flow rate out of the relief-cut-control target pump flow rate and the positive control target pump flow rate enables both securing high acceleration performance at the time of start of turning and reducing a relief loss to be achieved. "Giving priority to a lower target pump flow rate of the relief-cut-control target pump flow rate and the positive-control target pump flow rate" intends to define a relative relationship between the two target pump flow rates, not intending to exclude a mode of generating a pump capacity command based on a minimum target pump flow rate that is lower than either of the relief-cut-control target pump flow rate and the positive-control target flow rate (for example, the horsepower-control pump flow rate) like the above embodiment.

As described above, there is provided a turning drive apparatus for hydraulically turning a turning body included in a work machine, the apparatus being capable of securing high acceleration performance at the start of the turning with a reduced relief loss.

Provided is a turning drive apparatus installed in a work machine, which includes a machine body, a turning body turnably mounted on the machine body, and an engine that generates a power for driving the turning body, to hydraulically turn the turning body, the apparatus including: a variable displacement hydraulic pump that is driven by the engine to discharge hydraulic fluid; a turning motor composed of a hydraulic motor that is operated by supply of hydraulic fluid from the hydraulic pump to the hydraulic motor to turn the turning body; a turning control device operated by application of a turning command operation to the turning control device to allow hydraulic fluid to be supplied from the hydraulic pump to the turning motor to turn the turning body; a relief valve provided in a relief flow path for releasing hydraulic fluid discharged from the hydraulic pump to a tank and configured to open so as to restrict a pump pressure, which is a pressure of hydraulic fluid supplied to the turning motor, to a preset pressure or less; a turning speed detector that detects a turning speed of the turning body; and a flow rate control device that changes a pump capacity, which is a capacity of the hydraulic pump, when the turning command operation is applied to the turning control device, to thereby control a pump flow rate, which is a flow rate of the hydraulic fluid discharged from the hydraulic pump. The flow rate control device includes: a turning-speed flow rate calculation part that calculates a turning-speed flow rate, which is a flow rate of hydraulic fluid to be made to flow through the turning motor in accordance with the turning speed detected by the turning speed detector when the turning body is turned; a relief-cut-control target flow rate calculation part that calculates a relief-cut-control target pump flow rate, which is a target value of the pump flow rate, on the basis of a sum of the turning-speed flow rate and a minimum relief flow rate, which is a relief flow rate of the hydraulic fluid flowing through the relief valve and a minimum flow rate necessary for securing the pump pressure necessary for opening the relief valve to start the turning body; and a pump capacity command part that inputs a pump capacity command for changing the pump capacity so as to provide the relief-cut-control target pump flow rate that is calculated by the relief-cut-control target pump flow rate calculation part. The relief-cut-control target pump flow rate calculation part and the pump capacity command part are configured to make the pump capacity larger than the pump capacity corresponding to the sum of the minimum relief flow rate and the turning-speed flow rate at a time of turning start in which the turning command operation is applied to the turning control device and the turning speed is lower than a setting turning speed that is preset.

This turning drive apparatus, making the actual pump capacity larger than the pump capacity corresponding to the sum of the minimum relief flow rate and the motor flow rate at the time of the start of the turning to thereby increase the volumetric efficiency, that is, giving more priority to the securement of the volumetric efficiency than the reduction of the relief loss at the time of starting turning, enables high acceleration performance to be secured, while basically executing a relief cut control of securing a pump flow rate required for turning the turning body at a current turning speed with a reduced relief flow rate.

As a specific mode for rendering the pump capacity large, the relief-cut-control target pump flow rate calculation part is preferably configured to set a turning start flow rate for increasing the pump capacity at the time of turning start and configured to calculate the relief-cut-control target pump flow rate on the basis of a flow rate obtained by adding the turning start flow rate to the sum of the minimum relief flow rate and the turning-speed flow rate at the time of turning start. This embodiment allows the pump capacity at the time of turning start to be properly increased by a simple arithmetic operation of adding the turning start flow rate to the sum of the minimum relief flow rate and the turning-speed flow rate for the calculation of the target pump flow rate at the time of turning start.

More specifically, it is preferable that the turning start flow rate be set so as to be decreased with an increase in the turning speed. This makes it possible to secure a large pump capacity and a high volumetric efficiency by setting a large turning start flow rate especially when the turning speed is low even at the time of turning start, and to increase the priority of reducing the relief loss by reducing the target pump flow rate with a decrease in the requirement for acceleration due to an increase in the turning speed.

In this case, the turning start flow rate is preferably set so as to be continuously decreased to zero with an increase in the turning speed to the setting turning speed. This prevents the pump capacity from being abruptly changed by an increase in the turning speed across the setting turning speed, thereby enabling smoother turning drive to be performed.

It is preferable that the flow rate control device further includes a positive-control pump flow rate calculation part that calculates a positive-control target pump flow rate for increasing the pump capacity with an increase in the turning command operation applied to the turning control device, and that the pump capacity command part is configured to generate the pump capacity command with priority to a lower target pump flow rate of the relief-cut-control target pump flow rate and the positive control target pump flow rate. This configuration, reducing the pump capacity to give priority to the positive-control target pump flow rate, allows the reduction of the relief loss to be prioritized, when the turning command operation applied to the turning control device is small, that is, when high acceleration is not required.

The invention claimed is:

1. A turning drive apparatus provided in a work machine, which includes a machine body, a turning body turnably mounted on the machine body, and an engine for generating power for driving the turning body, to hydraulically turn the turning body, the turning drive apparatus comprising:

a variable displacement hydraulic pump that is driven by the engine to discharge hydraulic fluid;

a turning motor composed of a hydraulic motor that is operated by supply of hydraulic fluid from the hydraulic pump to the hydraulic motor to turn the turning body;

a turning control device operated by application of a turning command operation to the turning control device to allow hydraulic fluid to be supplied from the hydraulic pump to the turning motor to turn the turning body;

a relief valve provided in a relief flow path for releasing hydraulic fluid discharged from the hydraulic pump to a tank and configured to open so as to restrict a pump pressure, which is a pressure of hydraulic fluid supplied to the turning motor, to a preset pressure or less;

a turning speed detector that detects a turning speed of the turning body; and a flow rate control device that changes a pump capacity, which is a capacity of the hydraulic pump, when the turning command operation is applied to the turning control device, to thereby control a pump flow rate, which is a flow rate of the hydraulic fluid discharged from the hydraulic pump, wherein the flow rate control device includes: a turning-speed flow rate calculation part that calculates a turning-speed flow rate, which is a flow rate of hydraulic fluid to be made to flow through the turning motor in accordance with the turning speed detected by the turning speed detector when the turning body is turned; a relief-cut-control target flow rate calculation part that calculates a relief-cut-control target pump flow rate, which is a target value of the pump flow rate, on the basis of a sum of the turning-speed flow rate and a minimum relief flow rate, which is a relief flow rate of the hydraulic fluid flowing through the relief valve and a minimum flow rate necessary for securing the pump pressure necessary for opening the relief valve to start the turning body; and a pump capacity command part that inputs a pump capacity command for changing the pump capacity so as to provide the relief-cut-control target pump flow rate that is calculated by the relief-cut-control target pump flow rate calculation part, and wherein the relief-cut-control target pump flow rate calculation part and the pump capacity command part are configured to make the pump capacity larger than the pump capacity corresponding to the sum of the minimum relief flow rate and the turning-speed flow rate at a time of turning start in which the turning command operation is applied to the turning control device and the turning speed is lower than a setting turning speed that is preset.

2. The turning drive apparatus for a work machine according to claim 1, wherein the relief-cut-control target pump flow rate calculation part is configured to set a turning start flow rate for increasing the pump capacity at the time of the turning start, and configured to calculate the relief-cut-control target pump flow rate on the basis of a flow rate obtained by adding the turning start flow rate to the sum of the minimum relief flow rate and the turning-speed flow rate at the time of the turning start.

3. The turning drive apparatus for a work machine according to claim 2, wherein the turning start flow rate is set so as to be decreased with an increase in the turning speed.

4. The turning drive apparatus for a work machine according to claim 3, wherein the turning start flow rate is set so as to be continuously decreased to zero with an increase in turning speed to the setting turning speed.

5. The turning drive apparatus for a work machine according to claim 1, wherein the flow rate control device further includes a positive-control pump flow rate calculation part that calculates a positive-control target pump flow rate for increasing the pump capacity with an increase in the turning command operation applied to the turning control device, and the pump capacity command part is configured to generate the pump capacity command with priority to a lower target pump flow rate of the relief-cut-control target pump flow rate and the positive control target pump flow rate.

* * * * *